United States Patent [19]

Reneau

[11] 4,198,573

[45] Apr. 15, 1980

[54] AUTOMATIC MEMORY AND ENVIRONMENTAL SECURITY SYSTEM

[76] Inventor: Paul A. Reneau, 4105 N. Montreal St., Milwaukee, Wis. 53216

[21] Appl. No.: 867,692

[22] Filed: Jan. 9, 1978

[51] Int. Cl.[2] ..... H01H 47/32

[52] U.S. Cl. ..... 307/10 R; 307/118; 361/178; 361/190; 180/289

[58] Field of Search ..... 307/10 R, 10 AT, 9; 361/71, 75, 195, 196, 166, 167, 193, 190; 180/114, 112; 340/63, 64, 545; 49/21, 31; 328/4

[56] References Cited

U.S. PATENT DOCUMENTS

| | | | |
|---|---|---|---|
| 1,672,049 | 6/1928 | Almquist | 361/166 |
| 1,913,699 | 6/1933 | Crago | 361/166 |
| 2,842,680 | 7/1958 | Cromwell | 307/10 R |
| 3,914,663 | 10/1975 | Johnson | 307/10 R |

*Primary Examiner*—L. T. Hix
*Assistant Examiner*—S. D. Schreyer

[57] ABSTRACT

The Automatic Memory and Environmental Security System is a solid state electronic device to be employed in a motor vehicle for the specific purpose of closing any and all electrically operated windows, and roof panel, and locking any and all electrically operated door locks, which may have been left open or unlocked purposely or inadvertently. The system is also designed to close any and all electrically operated windows and roof panel left open when the surrounding humidity reaches 100% (the appearance of rain, drizzle, etc.). The unit is designed so that there is no interference with the normal operation of the above-named electrical device(s) after being employed in the said vehicle.

8 Claims, 1 Drawing Figure

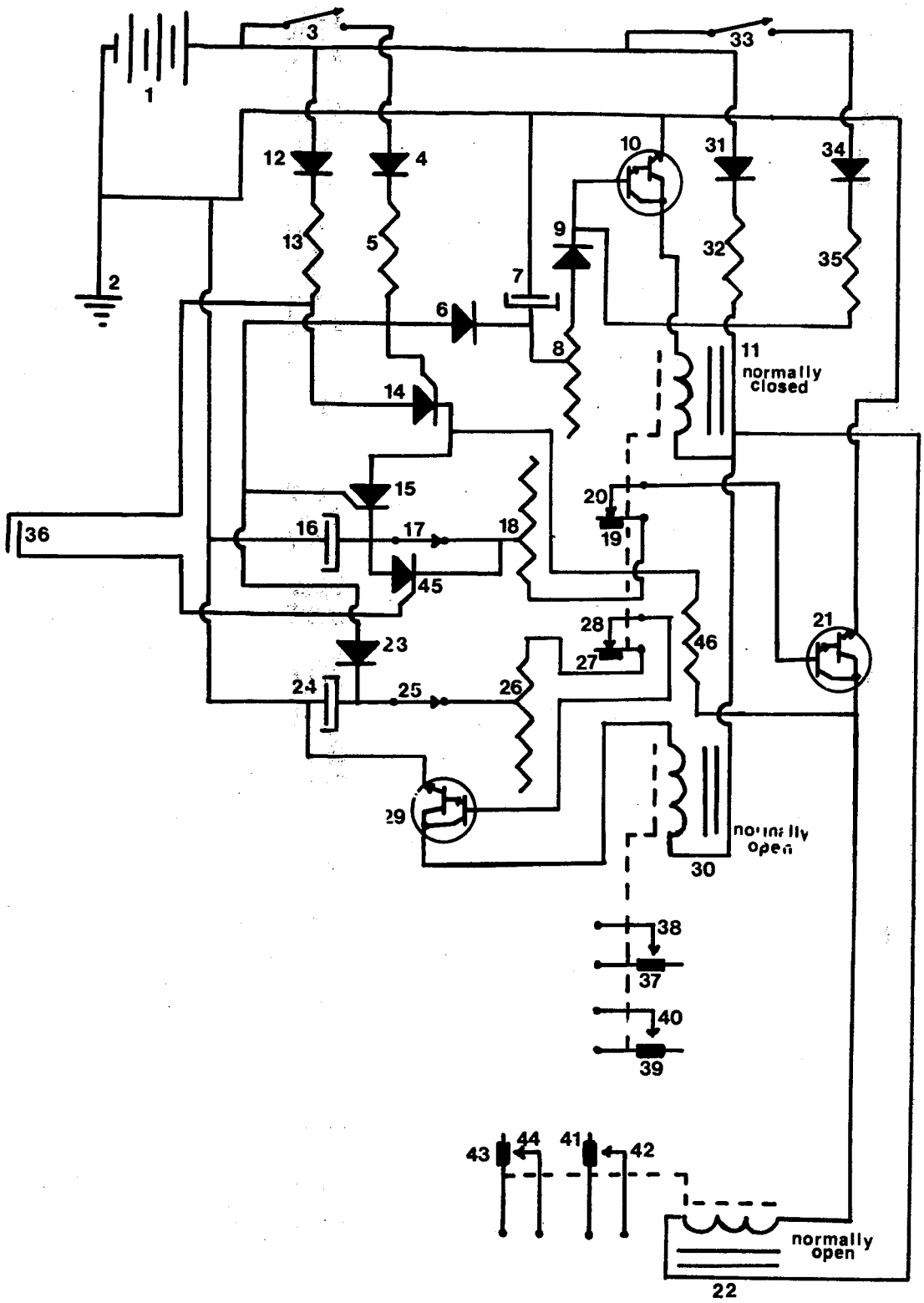
1
2
3
4
5
6
7
8
9
10
11
normally closed
12
13
14
15
16
17
18
19
20
21
22
normally open
23
24
25
26
27
28
29
30
normally open
31
32
33
34
35
36
37
38
39
40
41
42
43
44
45
46

AUTOMATIC MEMORY AND ENVIRONMENTAL SECURITY SYSTEM

OUTLINE OF THE DRAWING

The one FIGURE is an electrical schematic diagram of the dislosed invention for an automatic memory and environmental security system.

DESCRIPTION OF SCHEMATIC

Voltage is supplied to the device at five points, V1, V2, V3, V4, and V5, and is positive (+).

Current from V1 passes thru R1 and charges capacitors C1 and C2 directly, and activates silicon controlled rectifiers (scr) X6 and X7, which allows for the charging of capacitor C3 from voltage source V2 thru resistor R4. Current from V1 activates transitor Q1 which engages relay K1, with current supplied from V3 thru R7. When V1 is eliminated, Q1 continues to engage K1 by current supplied supplied from C1 thru potentiometer R2. The resistance setting of R2 determines the length of time Q1 engages K1. When K1 disengages, capacitors C2 and C3 are allowed to discharge thru potentiometers R3 and R5 respectively. This activates transistors Q2 and Q3 respectively, which engage Relays K2 and K3 respectively. K1 is normally closed with V1 off. Activating K2 allows for the engagement of the door lock motors M1&2 to the lock position by supplying positive current from V5 and negative ground.

Activating K3 allows for the engagement of window and roof panel motors M3,4&5 respectively, by supplying current from V5 and negative ground. All motors have an associated circuit breaker supplied thru the device as a protective measure against current overload, until the respective relay disengages. The length of engagement time is set by adjusting potentiometers R3 and R5, and is as close to the time interval necessary to completely close all related windows and roof panel when all are engaged in a completely open position. This eliminates the need for mechanical switches to cut current to the motors.

Capacitor C3 is continuosly charged from voltage source V1, and V2. When V1 is removed, C3 continues to charge from V2 until the output from transistor Q3 disrupts current flow thru X6 (scr). This disruption cuts off current flow thru X7 as well. This stops the charging of C3 and allows for C3's complete discharge thru Q3. C3 will continously charge after current from V1 is supplied to the gates of X6 and X7 again.

Headlamp delay-off

V4 supplies current of Q1 with headlamps on and continues to activate Q1 until the headlamps are off. This assure that K2 and K3 are not engaged until the headlamps are off. This aspect of the system is to be employed ONLY on vehicles with automatic headlamp delay-off.

Moisture Sensor

Current is supplied from V2 thru potentiometer R9, thru switch S2, to probe P1. Moisture simultaneously touching P1 and P2 allows current to pass from P1 to P2, to the gate of X13 with S1a being open (unit turned off). Current then passes thru R5 to Q3 and allows for the engagement of K3. The moisture activation does *NOT* allow for the locking sequence.

Components List

No Exact values are required for the manufacture of the device. The only criteria to be met is that voltage and current ratings are not exceeded. The RC timing units are determined by the choice of R and C. Zener diodes are used at all voltage sources so that a safe initial working voltage is obtained. Components are chosen so that they can adquately operate the designated sections of the device without themselves being destroyed.

| | |
|---|---|
| V | Voltage (power source; positive +) |
| X | diode (rectifier) |
| R | resistor |
| C | capacitor |
| S | switch |
| K | relay |
| F | circuit breaker (automatic reset) |
| Q | transistor |
| P | probe |
| V1 | from ignition/accessory |
| V2 | from fuse panel |
| V3 | from fuse panel |
| V4 | from battery |
| V5 | from headlamps |
| X1 | zener diode |
| X2 | silicon rectifier |
| X3 | silicon rectifier |
| X4 | silicon rectifier |
| X5 | zener diode |
| X6 | silicon controlled rectifier(scr) |
| X7 | silicon controlled rectifier(scr) |
| X8 | silicon rectifier |
| X9 | silicon rectifier |
| X10 | silicon rectifier |
| X11 | zener diode |
| X12 | zener diode |
| X13 | silicon controlled rectifier(scr) |
| X14 | silicon rectifier |
| C1 | 30μf capacitor |
| C2 | 1μf capacitor |
| C3 | 15μf capacitor |
| R1 | 550 ohm resistor |
| R2 | 1 megohm potentiometer |
| R3 | 1 megohm trimmer |
| R4 | 550 ohm resistor |
| R5 | 1 megohm trimmer |
| R6 | 100 Kohm resistor |
| R7 | 220 ohm resistor |
| R8 | 550 ohm resistor |
| R9 | 5 megohm trimmer |
| Q1 | Darlington high gain transistor |
| Q2 | Darlington high gain transistor |
| Q3 | Darlington high gain transistor |
| K1 | sensitive relay DPDT |
| K2 | power relay DPDT |
| K3 | power relay (4PDT, 6PDT, 8PDT, 10PDT) |
| S1 | DPST switch |
| S2 | SPST switch |
| S3 | driver's side door lock switch |
| S4 | passenger's side door lock switch |
| S5 | driver's side window switch |
| S6 | passenger's side window switch |
| S7 | roof panel switch |
| M1 | driver's side door lock motor |
| M2 | passenger's side door lock motor |
| M3 | driver's side window motor |
| M4 | passenger's side window motor |
| M5 | roof panel motor |
| F1 | circuit breaker (automatic reset) |
| F2 | circuit breaker (automatic reset) |
| F3 | circuit breaker (automatic reset) |
| F4 | circuit breaker (automatic reset) |
| P1 | moisture sensor probe |
| P2 | moisture sensor probe |

I claim:

1. I claim a system, the combination comprising a storage battery, a first direct current relay with sets of normally closed contacts, a second and third direct current relay, each having sets of normally open contacts, circuits for engaging said relays, the said engaging of any said relay is by means of actuating an amplifier tied to the coil of the said relay, three RC timing units, each for engaging one relay by said means of activating said amplifier, the said first unit for engaging the said first relay, the said second unit for engaging the said second relay, the said third unit for engaging the said third relay, the said RC timing units each consisting of a resistor and condensor (capacitor), each said RC unit connected in parallel in the corresponding engaging circuit between said battery and said corresponding amplifier, the said engaging circuit for the said first relay having a primary switch in series between said battery and said relay coil, and may have additional switches in parallel to said primary switch for opening and closing said circuit, the closing of any said switches engaging said coil of said first relay and opening said normally closed contacts, the charging of said condensors for all said RC timing units is by means of closing said primary switch, and all other switches in series between said battery and any said condensor(s), the circuit between said battery and any said condensor comprising a charging circuit, the termination of said charging of any said condensor(s) is by means of opening said charging circuit(s), the complete discharge of said first condensor is by means of opening said primary switch, the complete discharge of said second and third condensors is by means of both the termination of said charging of said condensors, and the de-energizing of said coil for said first relay, the said de-energizing returning said sets of open contacts to the normally closed position, each set of said closed contacts being in series between one said second or third condensor and said second or third corresponding amplifier tied to said second or third relay coil, each said engaging circuit for said second and third relays also having one or more separate secondary switches connected in series between said corresponding condensor and said relay coil for opening and closing said engaging circuit, the energizing of said second and third relay coils closing said sets of normally open contacts for said second and third relays, the de-energizing of said relay coils returning said sets of second and third relay contacts to the normally open position.

2. I claim a system described in claim 1, also having any switches in series between said battery and said third condensor closed by means of closing said primary switch, the termination of said charging of said third condensor is by means of opening said charging circuit by means of opening any of said switches between said battery and said condensor, the opening of any said switches occuring only after the opening of said primary switch, but not necessarily in response or corresponding to the opening of said primary switch.

3. I claim a system described in claim 2, also having said switch(es) between said battery and said third condensor being an scr type switch(es).

4. I claim a system described in claim 3, also having the opening of said charging circuit by means of activating said third amplifier, said third amplifier output opening one or more said scr switches.

5. I claim a system described in claim 2, also having the discharge of only said third condensor with said secondary switch(es) between said third condensor and said third relay coil open by means of a closed switch in shunt(parallel) with said open secondary switch(es) between said third condensor and said third relay coil.

6. I claim a system described in claim 5, also having the said switch in shunt(parallel) closed by means of closing another switch in series between said battery and said switch in shunt with said open secondary switch(es).

7. I claim a system described in claim 6, also having the said switch in shunt(parallel) with said open secondary switch(es) being an scr type switch.

8. I claim a system described in claim 7, also having the said scr switch in shunt(parallel) with said open secondary switch(es) closed by means of activating the gate of said scr switch by said means of closing said other switch in series between said battery and said gate of said scr switch.

* * * * *

UNITED STATES PATENT AND TRADEMARK OFFICE

CERTIFICATE OF CORRECTION

PATENT NO. : 4,198,573

DATED : April 15, 1980

INVENTOR(S) : Paul A. Reneau

It is certified that error appears in the above—identified patent and that said Letters Patent is hereby corrected as shown below:

Columns 1-4 of the above-identified should be deleted to insert the attached columns 1-4 respectively therefor.

Signed and Sealed this

*Seventh* Day of *October 1980*

[SEAL]

*Attest:*

SIDNEY A. DIAMOND

*Attesting Officer*

*Commissioner of Patents and Trademarks*

AUTOMATIC MEMORY AND ENVIRONMENTAL SECURITY SYSTEM

SUMMARY OF INVENTION

The Automatic Memory and Environmental Security System is a device to be employed in a motor vehicle for automatically actuating chosen electrically operated devices after a pre-chosen time interval. The device is designed so that all of the said, or just selected of the said chosen devices will be actuated in response to changes in the environment (rain, temperature, daylight, etc.) also. The device is designed so that both modes of operation (after a pre-chosen time, and in response to environmental changes) are combined into one unit, thus allowing for the operation of one mode if the other is off or inoperative.

OUTLINE OF THE DRAWING

The one FIGURE is an electrical schematic diagram of the disclosed invention for an automatic memory and environmental security system.

SPECIFICATION

In the electronic schematic, number 1, designates a storage battery, grounded at number 2.

Voltage is supplied from 1 to the circuit beginning at switch 3, which is open. When the ignition is on or in the accessory position, switch 3 is closed and circuit consisting of components NPN Darlington transistor number 10 diode 9, potentiometer 8, capacitor 7, grounded at 2, diode 6, resistor 5, diode 4, and grounded at 2, is completed. This circuit constitutes a conventional RC timing circuit, and is sufficient for application in this device.

The output from transistor 10, drives normally closed DPST sensitive relay 11, with voltage supplied from 1, to diode 31, resistor 32, to relay 11. Voltage is also supplied from 1 to switch 33, which is closed with the headlight switch closed to diode 34, resistor 35, to transistor 10, and allows 10 to drive relay 11, with voltage supplied from 1, to diode 31, resistor 32, to relay 11. This provides a means for delaying the closing of the chosen actuating circuits until the headlights are extinguished, thus reducing drain on the battery. After switches 33, and 3, are open, relay 11, disengages after timing circuit discontinues input to transistor 10, and returns to the normally closed position, and relay 11 contacts 19 and 20, and 27 and 28, are closed. Voltage from battery 1, to switch 3, is supplied to diode 4, resistor 5, to the gates of scr's 14 and 15, and switches them into a conductive state, with voltage supplied from 1, to diode 12, resistor 13, and allows for the continuous charging of capacitor 16, which is grounded at 2. Voltage from switch 3, to diode 4, to resistor 5, to diode 23, allows for the charging of capacitor 24, which is grounded at 2. Switches 17 and 25 are normally closed. When relay 11 contacts 19 and 20, and 27 and 28, are returned to the normally closed position, capacitor 24, is allowed to discharge through potentiometer 26, and relay 11 contacts 27 and 28, as input to NPN Darlington transistor 29, which is grounded at 2. The output of transistor 29, drives normally open N*PST power relay 30, with voltage supplied from 1, to diode 31, and resistor 32. Relay 30 contacts 37 and 38, and 39 and 40, are now closed, thus closing desired actuating circuits. At the same instant that capacitor 24, discharges, voltage continuously charging capacitor 16, is allowed to pass through closed switch 17, potentiometer 18, closed relay 11 contacts 19 and 20, to NPN Darlington transistor 21, grounded at 2, whose output drives NPST power relay 22, with voltage supplied from 1, to diode 31, and resistor 32.

Transistor 21 output through resistor 46, also disrupts current flow through scr's 14, and 15, continuously charging capacitor 16, and returns scr 15, to the non-conductive state. This allows for the complete discharge of capacitor 16, through closed switch 17, potentiometer 18, closed relay 11 contacts 19 and 20, to transistor 21.

The discharge rate of capacitor 16, is based on the resistance of potentiometer 18, and 16 and 18 constitute a conventional RC timing circuit, whose output activates transistor 21, which in turn drives normally open power relay 22, and closes relay 22 contacts 41 and 42, and 43 and 44, thus closing the desired actuating circuits.

Upon complete discharge of capacitor 16, through potentiometer 18, closed relay 11 contacts 19 and 20, transistor 21 is deactivated, and discontinues to drive relay 22, thus opening relay 22 contacts 41 and 42, and 43 and 44, opening the desired actuating circuits. Capacitor values for 16 and 24, can be selected, and the resistance settings for potentiometers 18 and 26, can be adjusted so that the discharge rates of both capacitors 16 and 24, can be the same or different.

Relay 30, and relay 22, both engage simultaneously with switches 17, and 25, both closed, when relay 11 open contacts 19 and 20 and 27 and 28, close simultaneously. Thus by adjusting the foresaid timing circuits, the sets of relay contacts 41 and 42 and 43 and 44, for relay 22, and 37 and 38 and 39 and 40 for relay 30, will close actuating circuits simultaneously, and open them either simultaneously or sequentially. As fore-stated, all contacts for each individual relay open and close together, thus actuating circuits closed and opened by the contacts of a particular relay will close and open together. The advantage of this arrangement is to accommodate closing all desired actuating circuits at once so that the vehicle's interior is secured more quickly than by closing individual actuating circuits one at a time.

With switches 17 and 25 open, the fore-stated activation of said relays 30 and 22, is stopped, by not allowing the fore-stated discharge of capacitors 16 and 24. Circuits closed by closing their associated relay contacts remain open. This provides for preventing the vehicle from automatically securing itself (closing windows and roof, and locking doors), when securing is not desired or necessary, after both the ignition switch is returned to off position and switch 3 is open, and headlight switch is off, and switch 33 is open. Closing of switch 3 allows current to pass thru scr's 14 and 15 by gating them into the conducting state and continuously charging capacitor 16. With switch 17 open, voltage cannot reach potentiometer 18 to complete the circuit which drives relay 22. However, when moisture activated switch 36 is closed, voltage from 1, to diode 12 and resistor 13 triggers scr 45 into the conducting state, bypassing open switch 17, and going to potentiometer 18 and activating transistor 21, to drive relay 22 with voltage supplied from 1, to diode 31 and resistor 32, when relay 11 contacts 19 and 20 are closed. Transistor 21 output again allows for the complete discharge of capacitor 16 with switch 3 open, by disrupting current thru scr's 14

* N indicates any number, 1, 2, 3, etc.

and 15. Closing relay 22 contacts and 43 and 44 closes the desired actuating circuits (to windows and roof). No path is allowed for the discharge of capacitor 24, with switch 25 open, thus relay 30 will not engage, and close contacts 37 and 38 and 39 and 40, and close their corresponding actuating circuits (to door locks). The advantages of this switch (system) are as stated:

Simultaneous closure of windows and roof panel in response to a moisture sensitive switch, thus a more rapid securing of the vehicle's interior, and less the time allowed for the vehicle's interior to come in contact with damaging moisture.

Another advantage of this switch (system) is that in response to the fore-stated moisture switch, the door locks do not automatically engage, so that keys are not accidentally locked in the vehicle while it is being washed (automatic car washers often require that keys be left in the ignition in the off position, which will allow the switch to operate in response to moisture as fore-stated).

Switch 36 as stated is a moisture responsive switch which makes up no part of the invention itself, and can be replaced by any switch which when closed, activates scr switch 45. Moisture was one type of environmental response used, and choosing other types of switches which respond to changes in environment would not change the invention itself.

I claim:

1. I claim a system, the combination comprising a storage battery, a first direct current relay with sets of normally closed contacts, a second and third direct current relay, each having sets of normally open contacts, circuits for engaging said relays, the said engaging of any said relay is by means of actuating an amplifier tied to the coil of the said relay, three RC timing units, each for engaging one relay by said means of activating said amplifier, the said first unit for engaging the said first relay, the said second unit for engaging the said second relay, the said third unit for engaging the said third relay, the said RC timing units each consisting of a resistor and condensor (capacitor), each said RC unit connected in parallel in the corresponding engaging circuit between said battery and said corresponding amplifier, the said engaging circuit for the said first relay having a primary switch in series between said batery and said relay coil, and may have additional switches in parallel to said primary switch for opening and closing said circuit, the closing of any said switches engaging said coil and said first relay and opening said normally closed contacts, the charging of said condensors for all said RC timing units is by means of closing said primary switch, and all other switches in series between said battery and any said condensor(s), the circuit between said battery and any said condensor comprising a charging circuit, the termination of said charging of any said condensor(s) is by means of opening said charging circuit(s), the complete discharge of said first condensor is by means of opening said primary switch, the complete discharge of said second and third condensors is by means of both the termination of said charging of said condensors, and the de-energizing of said coil for said first relay, the said de-energizing returning said sets of open contacts to the normally closed position, each set of said closed contacts being in series between one said second or third condensor and said second or third corresponding amplifier tied to said second or third relay coil, each said engaging circuit for said second and third relays also having one or more separate secondary switches connected in series between said corresponding condensor and said relay coil for opening and closing said engaging circuit, the energizing of said second and third relay coils closing said sets of normally open contacts for said second and third relays, the de-energizing of said relay coils returning said sets of second and third relay contacts to the normally open position.

2. I claim a system described in claim 1, also having any switches in series between said battery and said third condensor closed by means of closing said primary switch, the termination of said charging of said third condensor is by means of opening said charging circuit by means of opening any of said switches between said battery and said condensor, the opening of any said switches occuring only after the opening of said primary switch, but not necessarily in response or corresponding to the opening of said primary switch.

3. I claim a system described in claim 2, also having said switch(es) between said battery and said third condensor being an scr type switch(es).

4. I claim a system described in claim 3, also having the opening of said charging circuit by means of activating said third amplifier, said third amplifier output opening one or more said scr switches.

5. I claim a system described in claim 2, also having the discharge of only said third condensor with said secondary switch(es) between said third condensor and said third relay coil open by means of a closed switch in shunt(parallel) with said open secondary switch(es) between said third condensor and said third relay coil.

6. I claim a system described in claim 5, also having the said switch in shunt(parallel) closed by means of closing another switch in series between said battery and said switch in shunt with said open secondary switch(es).

7. I claim a system described in claim 6, also having the said switch in shunt(parallel) with said open secondary switch(es) being an scr type switch.

8. I claim a system described in claim 7, also having the said scr switch in shunt(parallel) with said open secondary switch(es) closed by means of activating the gate of said scr switch by said means of closing said other switch in series between said battery and said gate of said scr switch.

* * * * *